United States Patent [19]

Imahashi

[11] 4,080,892

[45] Mar. 28, 1978

[54] APPARATUS FOR DRIVING DOTTING HAMMERS OF A MATRIX PRINTER

[76] Inventor: Issei Imahashi, 1321-1, Iwamori, Futaba-cho, Kitakoma, Yamanashi, Japan

[21] Appl. No.: 724,212

[22] Filed: Sep. 17, 1976

[30] Foreign Application Priority Data

Sep. 29, 1975 Japan ..... 50-117471

[51] Int. Cl.[2] ..... B41J 7/70

[52] U.S. Cl. ..... 101/93.04; 197/1 R; 101/93.09

[58] Field of Search ..... 101/93.04, 93.09, 93.05, 101/93.48; 197/1 R

[56] References Cited

U.S. PATENT DOCUMENTS

| | | | |
|---|---|---|---|
| 2,930,847 | 3/1960 | Metzger | 101/93.04 X |
| 3,281,853 | 10/1966 | Madeira et al. | 101/93.04 X |
| 3,715,978 | 2/1973 | Raider | 101/93.09 |
| 3,782,278 | 1/1974 | Barnett et al. | 197/1 R X |
| 3,797,387 | 3/1974 | Decker et al. | 101/93.09 |
| 3,941,051 | 3/1976 | Barrus et al. | 101/93.04 |

OTHER PUBLICATIONS

IBM Tech. Disclosure Bulletin, Dowd, Sept. 1974, vol. 17, No. 4, p. 1012–1013.

*Primary Examiner*—Edward M. Coven
*Attorney, Agent, or Firm*—Ian C. McLeod

[57] ABSTRACT

Apparatus is described for driving dotting hammers of a matrix printer consisting of a number of electro-magnets mounted in parallel at one side of the printing paper and at the other side of the paper, a number of electro-magnetic plates mounted in parallel to be attracted to said electro-magnets, wherein each plate has a dotting hammer for printing on the paper and wherein the electro-magnetic plates are driven for printing by the magnetic field of the electro-magnets passing through the printing paper. Letter printing on the printing paper is accomplished by dotting. The pitch or spacing arrangement of the paralleled electro-magnets is preferably half of the pitch arrangement of the electro-magnetic plates to be attached.

5 Claims, 2 Drawing Figures

APPARATUS FOR DRIVING DOTTING HAMMERS OF A MATRIX PRINTER

BACKGROUND OF THE INVENTION

This invention relates to an apparatus for driving dotting hammers of matrix printers which print a number of dots on paper to form letters with the dots.

For this type of printing apparatus or system it is necessary to provide scanning means to thoroughly scan the paper with the dotting hammers for dotting on all of the printing surface of paper with the dotting means and thus to print dots at specified points on the paper during scanning. Since so many dotting actions are required in a single scanning stroke, fast operation is required. For example, the dotting action of a dotting hammer for a second can be more or less 1,000 times. For this reason, apparatus for driving such dotting hammers are complex and have a high cost.

OBJECTS

Therefore one object of the present invention is to provide a driving apparatus for the dotting hammers of a matrix printer that has such a fast dotting action with very simple construction and low cost.

Another object of the present invention is to provide a driving apparatus for the dotting hammers of a matrix printer that can maintain a fast yet steady dotting action for a long period of time.

Other objects and advantages of the present invention will become more apparent as description proceeds and in reference to the accompanying drawings in which:

IN THE DRAWING

GENERAL DESCRIPTION

Apparatus is described for driving dotting hammers of a matrix printer comprising a number of electro-magnets placed in parallel at one side of the passage of printing paper, and at the other side a standard for a number of electro-magnetic plates reciprocably moved in direction normal to the direction of advancement of said printing paper, said electro-magnetic plates to be drawn being arranged in parallel and each made of a high magnetic substance and provided with a dotting hammer. Apparatus is also described for driving dotting hammers of a matrix printer characterized in that the pitch of arrangement of said paralleled electro-magnets is made a half of the pitch of arrangement of said drawn electro-magnetic plates.

The most suitable apparatus is constructed such that a number of electro-magnets are arranged at one side of the passage of printing paper and at the other side, a standard is provided with a number of electro-magnetic plates to be drawn arranged in parallel. Each plate is made of a highly magnetic material and is reciprocable in a direction normal to the direction of passage of the printing paper. It is preferred that the arrangement pitch of paralleled electro-magnets is half of the arrangement pitch of the electro-magnetic plates to be attracted to the electro-magnets.

SPECIFIC DESCRIPTION

Figure 1:
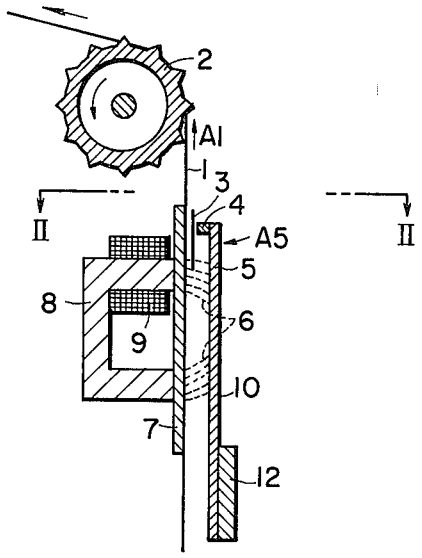
FIG. 1 is a cross-sectional view of a dotting hammer driving apparatus of a matrix printer which is one example of the apparatus of the present invention.

Referring to FIG. 1, a length of printing paper 1 is to be moved upward in the direction of arrow A1 by a sprocket 2. The printing paper 1 has holes mutually spaced for engaging the sprocket 2. An ink ribbon 3 for printing is closely spaced to the surface of the printing paper 1. In front of the printing paper 1, a dotting hammer 4 is disposed close to the ink ribbon 3. As shown in the drawings, the dotting hammer 4 is attached at the top end of electro-magnetic plates 5 which are to be drawn towards the printing paper 1. The electro-magnetic plates 5 are flexible and elongate and made of a highly magnetic material, for example a thin iron plate. The lower end of the plates 5 are secured to a standard 12 (the combination hereinafter simply referred to as the standard 12). A back stop 7 is disposed between the printing paper 1 and electro-magnets 8. This back stop 7 is made of a non-magnetic substance and is in the shape of a plate, for example a stainless steel plate or synthetic resin plate. The back stop 7 is placed so as to contact the printing paper 1. However, the back stop 7 can also be placed so as not to contact the printing paper 1.

The electro-magnets 8 attract the electro-magnetic plates 5 and have a coil 9. As can be seen from FIG. 1, the electro-magnets 8 are preferably C shaped with the coil 9 mounted on one leg and having both legs perpendicular to the plates 5.

In the operation of the apparatus, when an electric current is applied to the coil 9, the electro-magnets 8 generate a magnetic field 6. This magnetic field passes through the back stop 7 and printing paper 1 to operate the electro-magnetic plates 5 to be attracted to the electro-magnets 8. Thus a force is imparted to the electro-magnetic plates 5 to move them in a direction shown by Arrow A5 so that the plates 5 are flexed about the portion shown by 10 in FIG. 1, whereby the dotting hammers 4 strike the back stop 7 through the ink ribbon 3 and printing paper 1. In this way, dots are made on the printing paper 1 with the dotting hammers 4.

As seen in FIG. 2, 8-1, 8-2, 8-3, 8-4, 8-5, 8-6, 8-7 and 8-8 are each electro-magnets and 4-1, 4-2, 4-3 and 4-4 are each dotting hammers. Also 5-1, 5-2, 5-3 and 5-4 are each electro-magnetic plates. The electro-magnetic plates 5 are secured to the standard 12 at their lower ends respectively. The standard 12 is moved in the direction of arrow A12 and also in the direction of arrow A13. Thus the standard 12 is moved reciprocably for scanning in a lateral direction against the printing paper 1. Scanning against the printing paper 1 in a longitudinal direction is achieved by moving the paper upward bit by bit with the sprocket 2. The standard 12 reciprocates in the direction shown by arrow A12 and arrow A13. For ease of understanding, the displacement of the standard 12 in this reciprocal action is shown with dotted lines 12-2 and 12-3. However, this does not mean that the standard 12 moves away from the ink ribbon 3 to the positions shown in FIG. 2. Actually, the standard 12 moves along the ink ribbon 3 and, as illustrated, the standard 12 moves the distance B in the direction of Arrow A13 to the position 12-2. The position 12-3 shows that the standard 12 further moves in the direction of Arrow A13 a distance C. The position of the standard 12 shown by the solid lines is in an extreme in the direction of Arrow A12 and the position 12-3 is in an extreme in the direction of the Arrow A13.

Figure 2:
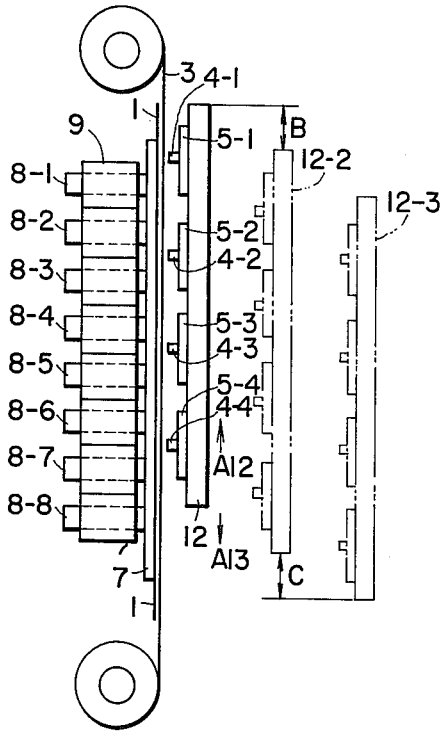
FIG. 2 is a cross-sectional view taken along the line II—II in FIG. 1, viewed in the direction of the arrow at II—II.

In this manner, the standard 12 reciprocates along the ink ribbon to and from the position of the standard 12 shown by the solid lines to and from the position 12-3. For scanning in a lateral direction of the printing paper as shown in FIG. 2, the standard 12 is moved more than the pitch (or spacing) of the electro-magnetic plates 5 to be drawn.

The following is an explanation as to the position of the electro-magnetic plates 5 to be drawn and action of the electro-magnets 8. When the standard 12 is between the position of the standard 12 shown by the solid line and the position 12-2 shown by chain line, the electro-magnets 8-1, 8-3, 8-5 and 8-7 act and electro-magnets 8-2, 8-4, 8-6 and 8-8 do not act. The group of non-active even numbered electro-magnets 8-2 to 8-8 are alternated with the group of odd numbered active magnets 8-1 to 8-7, whereby the acting electro-magnets 8-1 to 8-7 absorb into or direct lines of magnetic force to the adjacent non-acting electro-magnets 8-2 to 8-8 and thus magnetic blockage is made between two acting electro-magnets 8-1 and 8-3; 8-3 and 8-5 and 8-5 and 8-7.

When the standard 12 is in a position between the position 12-2 and the position 12-3, the electro-magnets 8-2, 8-4, 8-6 and 8-8 act and electro-magnets 8-1, 8-3, 8-5 and 8-7 do not act. These non-active electro-magnets 8-1, 3, 5 and 7 are alternately placed in the row of the electro-magnets 8 and thus the active electro-magnets 8-2, 4, 6 and 8 absorb into or direct magnetic force lines directed to the adjacent non-active electro-magnets 8-1, 3, 5 and 7, so that two adjacent active electro-magnets 8 are blocked from each other.

Thus two electro-magnets 8 are disposed so as to activate one electro-magnetic plate 5. That is, the arrangement pitch of electro-magnets 8 is fixed to be a half of the arrangement pitch of the electro-magnetic plates 5. Thus by changing position of the electro-magnetic plates 5 to be drawn and by switching the group of electro-magnets to be activated, it is possible to render stable actions to the dotting hammers 4 so that two plates 5 do not interfere with each other. As can be seen from FIG. 2, the electro-magnetic plates 5 can be positioned by movement of the standard 12 on one or the other side of the dotting hammers 4 for attraction by the electro-magnets 8.

As above, it will be apparent that the present invention provides an apparatus for driving the dotting hammers of a matrix printer which can operate in a high speed steady manner and which has a simple construction and low cost.

What is claimed is:

1. The improvement in an apparatus for driving dotting hammers of a matrix printer including means for moving printing paper which advances through the printer adjacent the hammers in one direction as the hammers dot the paper which comprises:

a. a plurality of electro-magnets mounted in parallel position on the printer along the printing paper in a direction normal to the direction of advancement of the paper and at one side of the printing paper;

b. at the other side of the paper a standard reciprocally moveable to various positions along the printing paper in a direction normal to the direction of advancement of said printing paper and moveable adjacent the parallel position of the electro-magnets; and c. flexible elongate electro-magnetically attractable plates each having a dotting hammer mounted along the standard in spaced parallel relation to the electro-magnets and adjacent the printing paper, wherein the electro-magnets attract the plates towards the electro-magnets and thus cause the dotting hammers to dot the paper as the standard is moved to the said variable positions and wherein the spacing of the electro-magnets mounted on the printer is one-half the spacing of the plates mounted on the standard, wherein there are twice as many electro-magnets as plates and wherein the electro-magnets are activatable alternately depending upon the position of the standard so that magnetic lines of force from an activated electro-magnet are absorbed by an adjacent non-activated electro-magnet while the activated electro-magnet attracts a plate.

2. The apparatus of claim 1 wherein the plates are composed of a thin sheet of iron so as to be flexible.

3. The apparatus of claim 1 wherein a back stop made of a non-magnetic material is positioned between the electro-magnets and the hammers on the plates such that the hammers strike the paper which is against the backstop.

4. The apparatus of claim 1 wherein the electro-magnets are C shaped with a current applying coil on one leg of the C and having both legs perpendicular to the plates.

5. The apparatus of claim 1 wherein a moveable ink ribbon is provided between the hammers and the paper.

* * * * *